US009795180B2

(12) United States Patent
Lowe et al.

(10) Patent No.: US 9,795,180 B2
(45) Date of Patent: Oct. 24, 2017

(54) SYSTEM AND METHOD FOR COUPLING HELMET COMPONENTS AND LINERS

(71) Applicant: Bell Sports, Inc., Scotts Valley, CA (US)

(72) Inventors: Michael W. Lowe, Santa Cruz, CA (US); Eamon Briggs, Santa Cruz, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 322 days.

(21) Appl. No.: 14/500,535

(22) Filed: Sep. 29, 2014

(65) Prior Publication Data

US 2015/0089725 A1 Apr. 2, 2015

Related U.S. Application Data

(60) Provisional application No. 61/883,918, filed on Sep. 27, 2013.

(51) Int. Cl.
*A42B 3/12* (2006.01)
*A42B 3/10* (2006.01)

(52) U.S. Cl.
CPC ..... *A42B 3/125* (2013.01); *A42B 3/10* (2013.01); *A42B 3/127* (2013.01)

(58) Field of Classification Search
CPC ..... A42B 3/127; A42B 3/063; A42B 3/064; A42B 3/10; A42B 3/12; A42B 3/125; A42B 3/128; A42B 3/14; A42B 3/145; A42B 3/124; A42B 3/06; A42B 3/062; A42B 3/065
USPC ..... 2/412, 414, 417, 418, 419, 5, 6.8
See application file for complete search history.

(56) References Cited

U.S. PATENT DOCUMENTS 3,153,792 A * 10/1964 Marietta ..... A42B 3/127 2/414
3,292,180 A * 12/1966 Marietta ..... A42B 3/12 2/415
3,447,162 A * 6/1969 Aileo ..... A42B 3/10 2/209
3,495,272 A * 2/1970 Tempelhof ..... A42B 3/127 2/181.4

(Continued)

FOREIGN PATENT DOCUMENTS

CZ 9300954 A3 2/1994

*Primary Examiner* — Amy Vanatta
(74) *Attorney, Agent, or Firm* — Booth Udall Fuller, PLC

(57) ABSTRACT

A helmet an include a shell, a liner disposed within the shell, a flexible band disposed between the shell and a portion of the liner to releasably couple the liner to the shell without glue, hook and loop fasteners, or snaps. The helmet can also include an energy-absorbing layer of expanded polystyrene (EPS) including a groove. The comfort liner can be attached to the energy-absorbing layer without glue, hook and loop fasteners, or snaps, and a flexible band can be releasably disposed between the energy-absorbing layer and the comfort liner. The helmet can also include a groove on an inner surface of an outer shell. An energy-absorbing liner can include expanded polypropylene (EPP), and a flexible band can be disposed between the outer shell and the energy-absorbing liner to provide additional energy management, to releasably couple the energy-absorbing liner to the outer shell, or both.

18 Claims, 5 Drawing Sheets

(56) References Cited

U.S. PATENT DOCUMENTS

| | | | | | |
|---|---|---|---|---|---|
| 3,613,113 | A * | 10/1971 | Alleo | A42B | 3/166 2/420 |
| 3,729,744 | A * | 5/1973 | Rappleyea | A42B | 3/127 2/420 |
| 3,820,163 | A * | 6/1974 | Rappeyea | A42B | 3/125 2/420 |
| 3,992,721 | A * | 11/1976 | Morton | A42C | 2/007 2/414 |
| 5,088,129 | A * | 2/1992 | Kamata | A42B | 3/127 2/411 |
| 5,517,691 | A | 5/1996 | Blake | | |
| 5,898,949 | A | 5/1999 | Barthold et al. | | |
| 6,202,223 | B1 * | 3/2001 | Chartrand | A42B | 3/127 2/410 |
| 6,453,476 | B1 * | 9/2002 | Moore, III | A42B | 3/125 2/412 |
| 8,239,970 | B2 * | 8/2012 | Ikeda | A42B | 3/127 2/267 |
| 2006/0206994 | A1 | 9/2006 | Rogers et al. | | |
| 2009/0158506 | A1 * | 6/2009 | Thompson | A42B | 3/127 2/411 |
| 2014/0223641 | A1 * | 8/2014 | Henderson | A42B | 3/127 2/411 |
| 2015/0272257 | A1 * | 10/2015 | Pritz | A42B | 3/127 2/414 |
| 2015/0272258 | A1 * | 10/2015 | Preisler | A42B | 3/127 2/412 |

* cited by examiner

SYSTEM AND METHOD FOR COUPLING HELMET COMPONENTS AND LINERS

RELATED APPLICATIONS

This application claims the benefit of U.S. provisional patent application 61/883,918, filed Sep. 27, 2013 titled "Helmet Liner," the disclosure of which is hereby incorporated herein by this reference.

TECHNICAL FIELD

This disclosure relates to a system and method for coupling helmet components and liners, such as impact liners or energy-absorbing liners, to helmet shells and to comfort liners or fit liners.

BACKGROUND

Protective head gear and helmets have been used in a wide variety of applications and across a number of industries including sports, athletics, construction, mining, military defense, and others, to prevent damage to a users head and brain. Damage and injury to a user can be prevented or reduced by preventing hard objects or sharp objects from directly contacting the user's head, and also from absorbing, distributing, or otherwise managing energy of the impact.

This disclosure provides a system and method for providing a helmet or protective head gear that includes an outer shell and an inner energy-absorbing layer, such as foam, that can be used for a cyclist, football player, hockey player, baseball player, lacrosse player, polo player, climber, auto racer, motorcycle rider, motocross racer, skier, snowboarder or other snow or water athlete, sky diver or any other athlete in a sport, or construction worker or person in a dangerous work environment or other person who is in need of protective head gear.

Bicycle helmets or cycling helmets are often formed as in-molded helmets. An in-molded helmet is one in which the outer shell of the helmet is bonded directly to the expanding foam (i.e. expanded polystyrene (EPS)) as it is expanding such that the foam is molded in the shell. Helmets that are not in-molded can be referred to as hard-shell helmets and include skate bucket helmets, motorcycle helmets, snow sport helmets, football helmets, batting helmets, catcher's helmets, and hockey helmets. FIG. 1A shows a hard-shell helmet 10 that might be used as a skate bucket helmet, such as for BMX riding and racing. An example of a hard-shell helmet 10 includes the Bell Segment helmet. Hard-shell helmet 10 would typically include comprise a hard outer shell 12, an impact liner 14, and a comfort liner 16.

The hard outer shell 12 can be formed of plastic such as Acrylonitrile butadiene styrene (ABS). The outer shell 12 is typically made hard enough to resist impacts and punctures, and to meet the related safety testing standards, while being flexible enough to deform slightly during impacts to absorb energy through deformation, thereby contributing to energy management.

An impact liner or energy-absorbing layer 14 is often disposed inside and adjacent to the hard outer shell 12. The energy-absorbing layer 14 can be made of plastic, polymer, foam, or other suitable energy-absorbing material that can flexibly deform with the hard outer shell 12 to absorb energy and to contribute to energy management without breaking. The energy-absorbing layer 14 can be one or more layers of expanded polypropylene (EPP). EPP can be advantageously used as an energy-absorbing and energy attenuating material that is flexible and is able to withstand multiple impacts without being crushed or cracking. To the contrary, EPS and expanded polyurethane (EPU) will absorb energy from an impact by being crushed or cracking. As such, EPS can be less effective or incapable of safely providing effective energy management to a user for multiple impacts, and is typically avoided for hard shell helmets or flexible helmets. The impact liner 14 is permanently coupled to the hard outer shell 12 with an adhesive or glue.

A comfort liner or fit liner 16 can be disposed inside a hard outer shell 12 and impact liner 14, while being disposed adjacent the impact liner. The comfort liner 16 can be made of textiles, plastic, foam, or other suitable material, such as polyester. The comfort liner 16 can be formed of one or more pads of material that can be joined together, or formed as discrete components, that are coupled to hard shell helmet 10. The comfort liner 16 can be releasably or permanently coupled to the impact liner 14 using snaps, hook and loop fasteners, adhesives, or other suitable materials. As such, comfort liner 16 can provide a cushion and improved fit for the wearer of hard shell helmet 10.

FIG. 1B shows an example of an in-molded bicycle or cycling helmet 20. The in-molded helmet 20 can comprise a thin outer shell 22, an impact liner or energy-absorbing layer 24, and a comfort liner or fit liner 26.

Thin outer shell 22 that can be formed of a plastic, resin, fiberglass, or other suitable material such as stamped polyethylene terephthalate (PET). Outer shell 22 can provide a material in which impact liner 24 can be in-molded, can provide a smooth aerodynamic finish, and can provide a decorative finish for improved aesthetics.

An impact liner or energy-absorbing layer 24 can be disposed inside and adjacent the outer shell 22. The energy-absorbing layer 24 can be made of plastic, polymer, foam, or other suitable energy-absorbing material to absorb energy and to contribute to energy management for protecting a wearer during impact. The energy-absorbing layer 24 can be an in-molded layer of EPS that will absorb energy from an impact by being crushed or cracking. The impact liner 24 can be permanently coupled to the outer shell 22 with an adhesive or glue. A comfort liner or fit liner 26 can be disposed inside the outer shell 22 and the impact liner 24, while being disposed adjacent the impact liner. The comfort liner 26 can be made of textiles, plastic, foam, or other suitable material, such as polyester. The comfort liner 26 can be formed of one or more pads of material that can be joined together, or formed as discrete components, that are coupled to the in-molded helmet 20. The comfort liner 26 can be releasably or permanently attached to the impact liner 24 using snaps, hook and loop fasteners, adhesives, or other suitable materials. As such, the comfort liner 26 can provide a cushion and improved fit for the wearer of the in-molded helmet 20.

SUMMARY

A need exists for a system and device for coupling helmet liners and helmet components. Accordingly, in an aspect, a helmet can comprise a shell, an energy-absorbing layer comprising EPS and a groove, and a comfort liner coupled to the energy-absorbing layer without glue, hook and loop fasteners, or snaps. A flexible band can be releasably disposed between the energy-absorbing layer and the comfort liner.

The helmet can further comprise the flexible band comprising a plastic hoop-shaped headband releasably coupled along the channel. The shell can comprise stamped PET. The helmet can further comprise a comfort liner coupled to the flexible band without glue, hook and loop fasteners, or snaps disposed within the shell.

In another aspect, a helmet can comprise an outer shell comprising a groove on an inner surface of the outer shell. An energy-absorbing liner of EPP disposed within the shell, and a flexible band can be disposed between the outer shell and the energy-absorbing liner.

The helmet can further comprise the flexible band comprising a halo shape mateable to the groove. The flexible band comprises detents snapped into the groove, wherein the groove comprises a ventilation opening formed in the outer shell. A comfort liner can be coupled to the energy-absorbing layer by a second flexible band.

In another aspect, a helmet can comprise, a shell, a liner disposed within the shell, and a flexible band disposed between the shell and a portion of the liner.

The helmet can further comprise the flexible band being releasably coupled to the shell without glue, hook and loop fasteners, or snaps. The flexible band can comprise uniformly circumferential forces to be secured around an equator of the shell. The flexible band can comprise an arch shape without forming a complete hoop or halo. The helmet can be formed with the shell as a hard-shell helmet and the liner comprising an energy-absorbing layer of EPP. The flexible band can comprise a halo shape disposed between the liner and the EPP layer, and detents snapped into ventilation openings formed in the shell. The halo can structurally reinforce the hard-shell helmet to allow the EPP energy-absorbing layer to have a thickness less than or equal to 2.5 cm. The halo can further comprise vinyl nitrile. The liner can further comprise an outer layer of EPS coupled to the shell, an inner layer of EPS comprising a custom-fit surface that matches a contour of a user's head, wherein the flexible band releasably couples the outer layer of EPS to the inner layer of EPS. The outer layer of EPS can comprise a curved channel formed around a periphery of the outer layer of EPS, and the flexible band can be disposed in the curved channel between the outer layer of EPS and the inner layer of EPS to releasably couple the inner layer of EPS to the outer layer of EPS and the shell. The shell can comprise stamped PET, the liner can comprise a comfort liner coupled to the flexible band without glue, hook and loop fasteners, or snaps, an energy-absorbing layer can comprise EPS and a channel configured to receive the flexible band, and the flexible band can comprise a plastic headband coupled between the comfort liner and the energy-absorbing layer. Additionally, a method of forming the helmet can comprise coupling the flexible band to the liner, and inserting the liner and flexible band within the shell such that the flexible band conforms to a portion of the liner and to a portion of the shell to couple the liner to the shell.

DETAILED DESCRIPTION

Figure 1A:
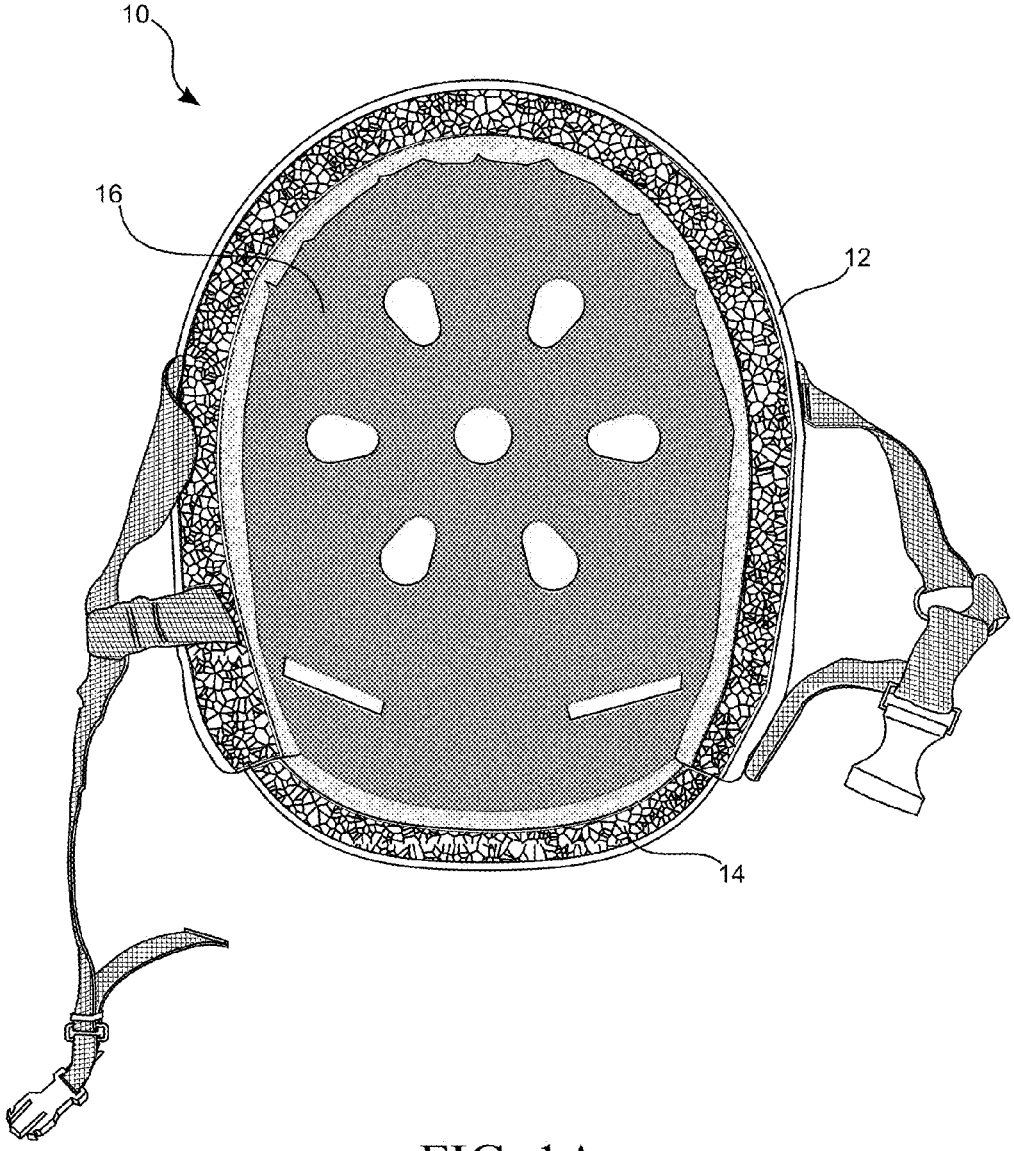
FIG. 1A PRIOR ART
FIGS. 1A and 1B show conventional helmets.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Figure 2A:
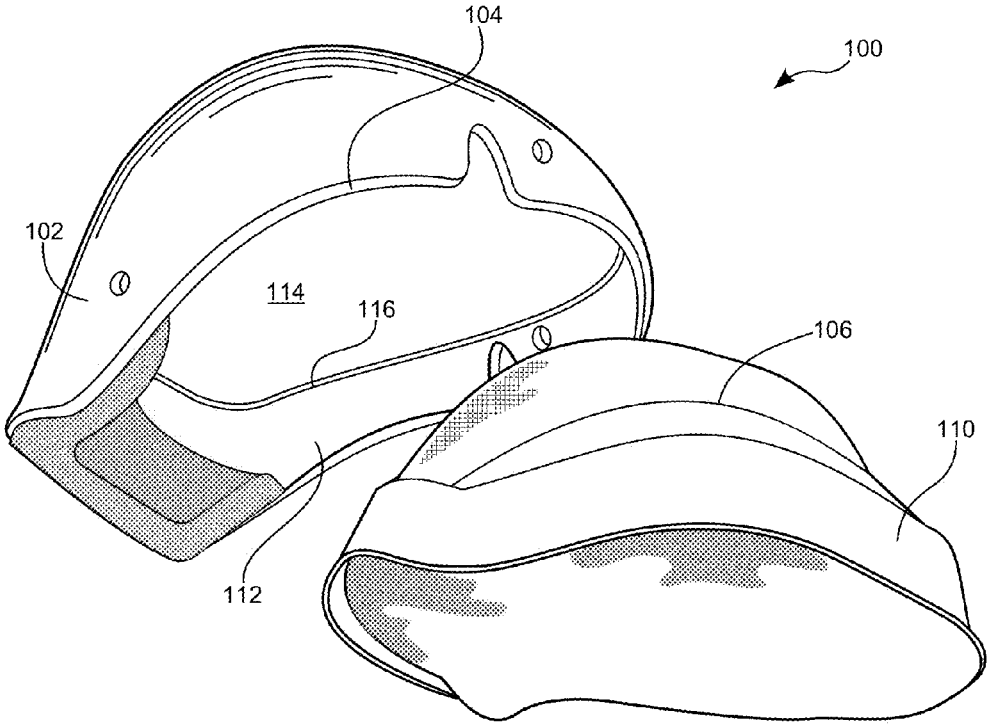
FIGS. 2A-2C show an embodiment of a comfort liner releasably coupled to an in-molded helmet.
Figure 2B:
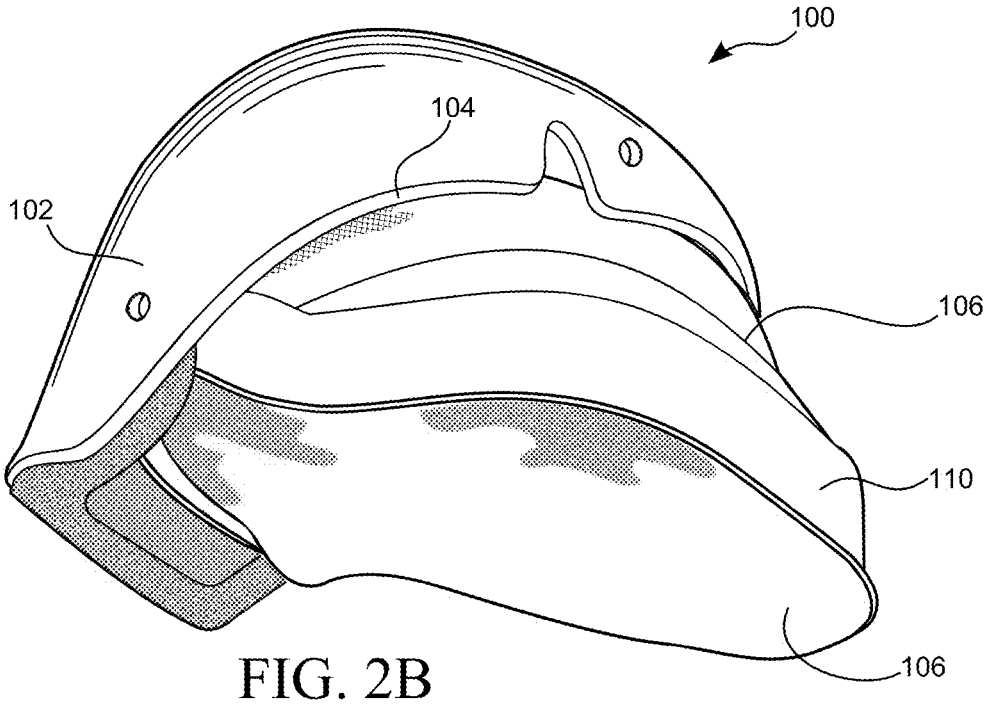
Figure 2C:
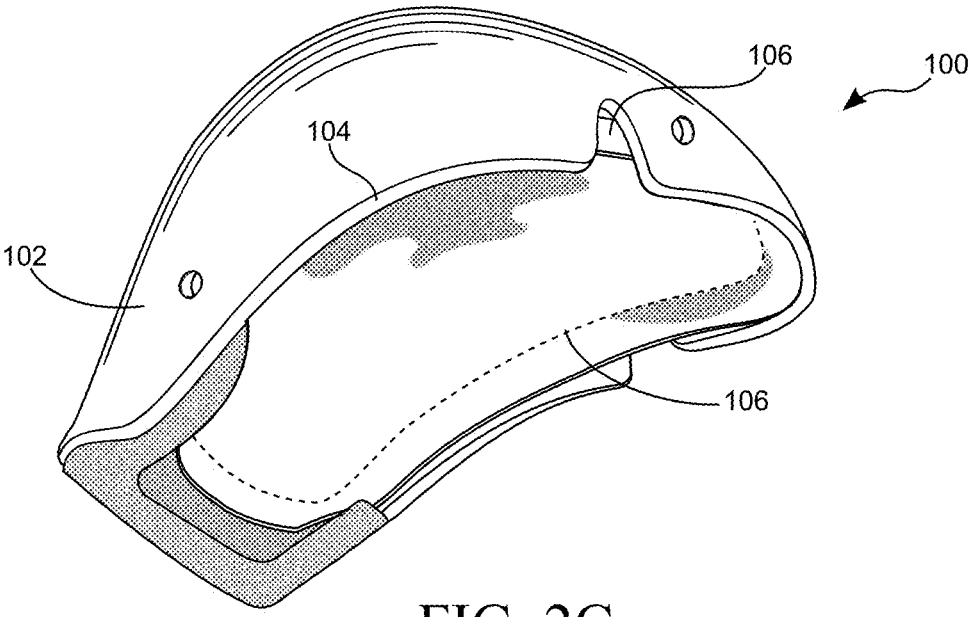

FIGS. 2A-2C show a non-limiting example of an in-molded bicycle or cycling helmet 100. FIG. 2A shows an in-molded helmet 100 can comprise an optional thin outer shell 102, an impact liner or energy-absorbing layer 104, a comfort liner or fit liner 106, an attachment band or hoop spring 110, and an attachment groove or channel 112.

The thin outer shell 102, when present, can be formed of a plastic, resin, fiberglass, or other suitable material such as stamped PET. The outer shell 102 can provide a material in which the impact liner 104 can be in-molded, can provide a smooth aerodynamic finish, and can provide a decorative finish for improved aesthetics.

An impact liner 104 can be disposed inside and adjacent to the outer shell 102, when present. In other instances, the impact layer 104 can form an outer surface of the helmet 100. The energy-absorbing layer 104 can be made of plastic, polymer, foam, or other suitable energy-absorbing material, such as EPS or EPU, to absorb energy and to contribute to energy management for protecting a wearer during impact. The energy-absorbing layer 104 can be an in-molded layer of EPS that will absorb energy from an impact by being crushed or cracking. The impact liner 104 can be permanently coupled to the outer shell 102.

The comfort liner 106 can be disposed inside the outer shell 102 and the impact liner 104, while being disposed adjacent the impact liner. The comfort liner 106 can be made of textiles, plastic, foam, or other suitable material, such as polyester. The comfort liner 106 can be formed of one or more pads of material that can be joined together, or formed as discrete components, that are coupled to the in-molded helmet 100. The comfort liner 106 can be releasably or permanently coupled or directly attached to the impact liner 104 with an attachment band 110 to provide a cushion and improved fit for the wearer of the in-molded helmet 100.

Figure 1B:
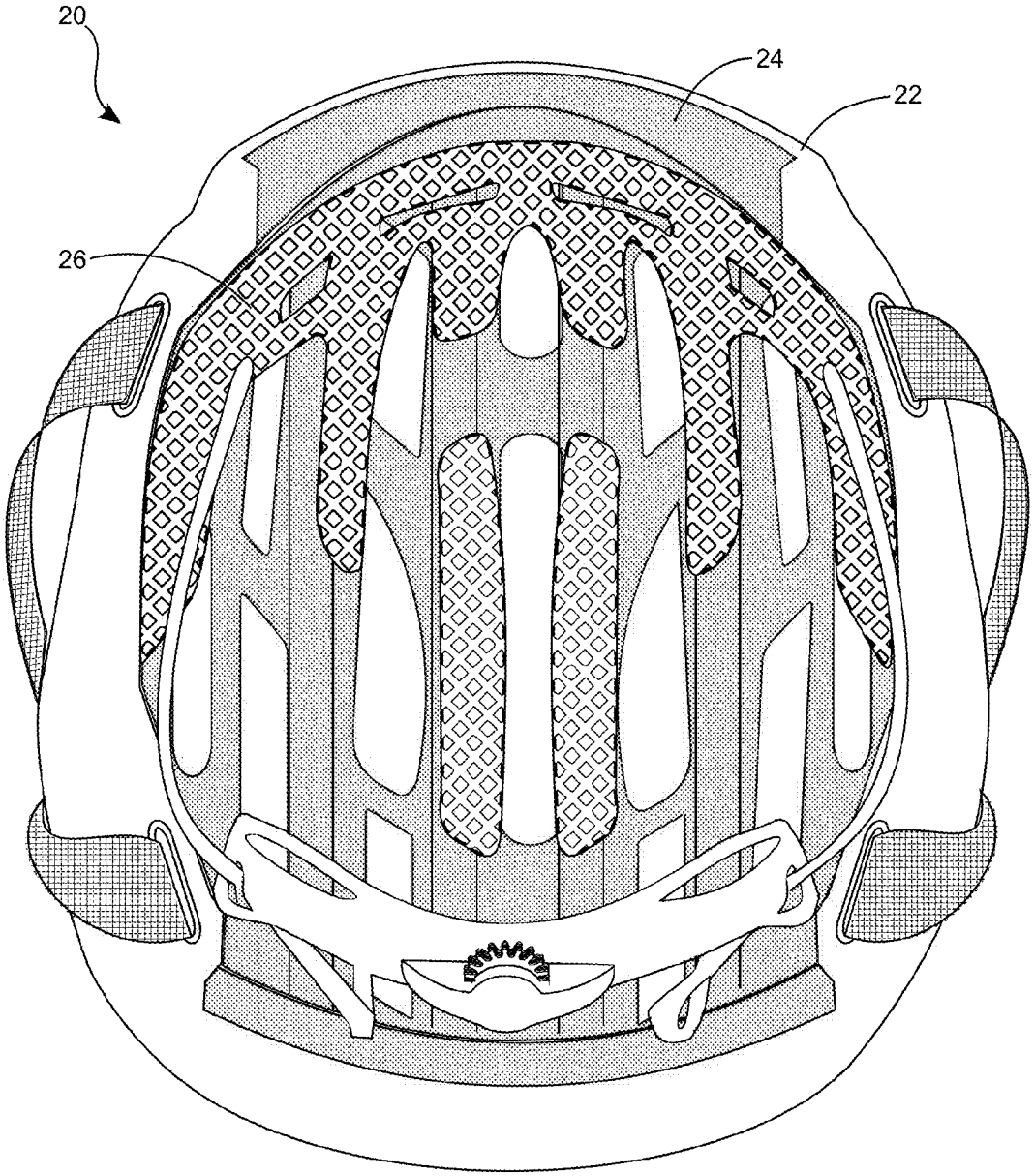
FIG. 1B PRIOR ART

As such, the attachment band 110 can replace conventionally used snaps, hook and loop fasteners, adhesives, or other materials as known in the prior art and discussed above with respect to FIG. 1B. The band 110 can include one or more layers of plastic including pliable or flexible plastics such as PE, PET, Vinyl Nitrile (VN), ABS, Polycarbonate, Polyvinyl Chloride (PVC), or other suitable plastics, as well as metal, fiberglass, carbon fiber, textiles, Kevlar or other springy semi-rigid and semi-flexible material, whether synthetic or natural. For example, a band 110 may comprise first and second layers, such as a plastic layer coupled to a layer of foam VN. A band 110 may have a thickness in a range of 0.01 mm-1.0 cm, and may comprise an annular, ring, hoop, halo, circular, oval or other closed shape that extends around a perimeter, equator, or circumference of the helmet. The band 110 may also be formed of a plurality of separate or disjointed pieces, such as two pieces that are strategically positioned to couple adjacent halves of the band to the helmet 100 in forming a complete band. Alternatively, a band 110 may be an open shape or strip such as an arch shaped strip that extends partially or entirely across the helmet 110, such as from a first side to a second side of the helmet, instead of being a closed shape that extends around a perimeter or circumference of the helmet. When the band 110 is formed as a strip, rather than as a hoop or halo, the strip can extend, for example, along a portion of the sagittal plane to resemble a mohawk. Additionally, the strip can also extend along the coronal plane or along any other plane or line along a helmet 100 surface. When the band 110 is formed as an open shape or strip, more than one strip or a plurality of strips can be used in combination with other strips, with a hoop or halo, or both. Regardless of the number, shape, or geometric configurations of the band or bands 110, the bands 110 can be elastically deformable to tend to spring back to an original position. The band 110 may be coupled to the comfort liner 106 by being sewn to, or through, the comfort liner, as well as by having loops or portions of the comfort liner formed, disposed, woven, sewn, or sealed around the band without glue, snaps, hook and loop fasteners, or other conventional forms of attachment that could be used for coupling a comfort liner to an impact liner. In some embodiments the band 110 can be sized and adapted to custom fit the head of a wearer.

A helmet 100 may also include an attachment groove or channel 112 formed in or on inner surface 114 of the impact liner 104. A groove 112 can be formed or bordered by a groove edge, sidewall, lip, or flange 116. The groove 112 can be recessed into the inner surface 114 so that groove edge 116 is formed between the inner surface 114 and a bottom surface 118 of the groove 112. Alternatively, the bottom surface 118 of the groove 112 can be substantially planar with the inner surface 114 so that the groove edge 116 is raised or offset with respect to the inner surface 114 and the bottom surface 118. The groove edge 116 can comprise a depth D that is equal to a thickness T of the band 110. The groove edge 116 can also comprise a depth D that is substantially equal to thickness T so that depth D comprises a distance that varies by 0-40% of a distance of thickness T. Thus, the groove 112 comprising a depth that corresponds to, is mateable with, or is configured to receive, the band 110. Similarly, one or more of a shape, size, area, and position of one or more grooves 112 can be equal or substantially equal to one or more of a shape, size, area, and position closed shaped bands 110, so that one or more of a shape, size, area, and position of one or more grooves 112 can corresponds to, be mateable with, or be configured to receive, one or more open or closed shaped bands 110. In some embodiments, an entirety of the band 110 corresponds to, is mateable with, or is configured to receive an entirety or a portion less than an entirety of the groove 112. In other embodiments, a portion of the band 110 less than an entirety of the band corresponds to, is mateable with, or is configured to receive an entirety or a portion less than an entirety of groove 112.

FIG. 2B shows a comfort liner 106 with a band 110 being inserted into, or disposed within, an impact liner 104 and adjacent an inner surface 114 of the liner. The band 110 and liner 106 can be inserted into the impact liner 104 all at once by compressing the band 110 and liner 106 to a volume or area less than a volume or area of the inner surface 114 of the impact liner 104 and then moving the band 110 and liner 106 within the impact liner 104, after which the band 110 and the impact liner 104 can expand to couple with at least a portion of a groove 112, inner surface 114, groove edge 116, or bottom surface 118, such as by directly contacting the groove, inner surface, groove edge, or bottom surface. Alternatively, the band 110 and liner 106 can be inserted into the liner 104 a piece at a time by inserting a first portion of the band 110 into a first portion of the groove 112, and then inserting a second portion of the band offset or opposite from the first portion into a second portion of the groove. As a non-limiting example, FIG. 2B shows a rear portion of the band 110 ring first coupled or mounted within a rear portion of the groove 112 in an impact liner 104. Due to the elastic, deformable, and resilient nature of the band 110, the band can elastically deform while being positioned within the helmet 100.

FIG. 2C shows a particular embodiment in which a band 110 can use uniformly circumferential forces, or substantially uniform forces, of the band to removably couple the hoop and a liner to a helmet 100. The forces generated and received by the band 110 can be applied along a portion or an entirety of a length or area of the band. In accordance with the description of the band 110 and the groove 112 above, the forces produced by, and applied to, the band 110 can be along or around a perimeter, equator, or circumference of the helmet as well as being along or around one or more open shapes or strips such as an arch shaped strip that extends partially or entirely across the helmet 110, such as from a first side to a second side of the helmet. When shaped as a strip, the band 110 can be fixed at its ends to portions of the helmet or liner. The liner can be an impact liner such as a liner 104, or a comfort liner, such as the liner 106. As such, an assembly coupled to the band 110 can comprise any padding, comfort, or impact absorbing materials previously known in the art.

Advantageously, using the band 110 for coupling the liner 106 to impact liner 104 allows for easy installation of the liner by workers assembling a helmet at a factory or at a store, as well as for helmet users at home or on the go doing an installation. Use of a band 110 can further provide for releasable coupling that can facilitate removal and installation of liners for cleaning, maintenance, and replacement. Pressure points that were created by conventional mechanical attachments devices such as snaps, buttons, clasps, and hook and loop fasteners are eliminated, as is the secondary operation of installing or fastening a plurality of conventional mechanical attachments, such as four or more attachments, which can be cumbersome and time consuming.

Moreover, embodiments comprising a hoop ring can additionally include using a band 110 to couple an impact liner 104 to a shell 102. For example, a band 110 can be integrally formed on or coupled to an impact liner 104 such as being in-molded with an EPS impact liner. A corresponding groove 112 can be formed in an outer shell 102 such that the EPS liner can be popped into the shell as part of a quick and efficient assembly at the factory for initial helmet assembly. Because glues and adhesives are typically used to attach a shell 102 to an impact liner 104, and because glues and adhesives typically contain solvents, which can be harmful to those assembling the helmets as well as harmful to the environment, the pop-in liner with band 110 can reduce harmful effects for workers and the environment.

Similarly, a band 110 can be used to couple a first impact liner 104*a* to a second impact liner 104*b*, in which the impact liner 104*a* is an outer impact liner coupled to a shell 102 and the impact liner 104*b* is a custom-fit impact liner comprising an outer surface that can be coupled to the first impact liner and further comprising an inner surface 114*b* opposite an outer surface 114*a* that matches a contour of the head of a wearer. The inner surface 114*b* of the second impact liner 104*b* can be formed from a scan or measurements of the head of a wearer after which the second impact liner 104*b* can then sent or mailed to the wearer for quick and efficient insertion of the second impact liner at home or any other location.

Figure 3A:
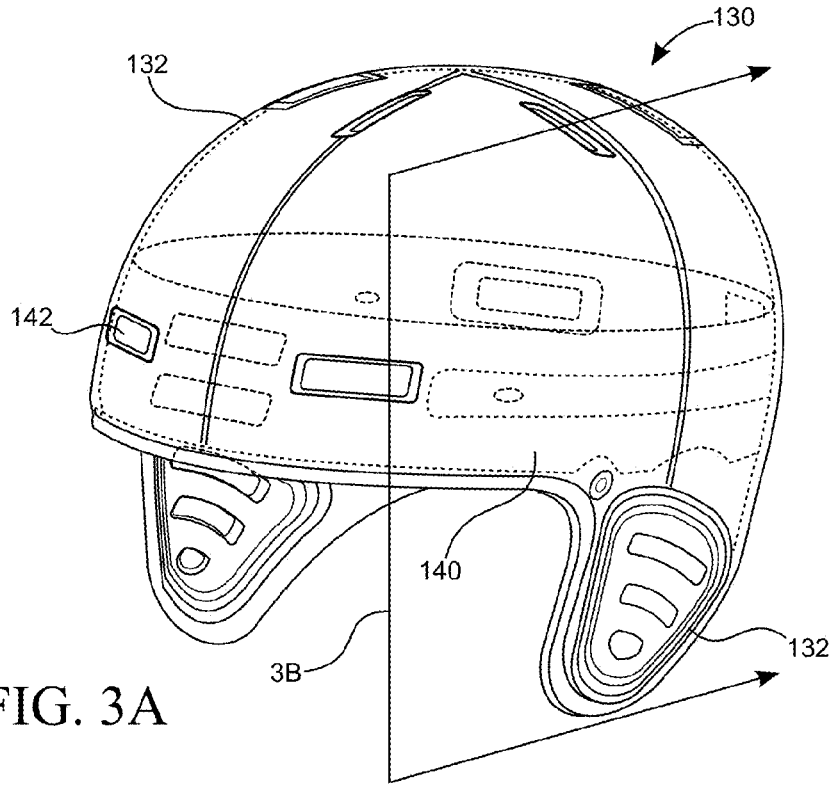
FIGS. 3A-3B show an embodiment of a comfort liner releasably coupled to a hard shell helmet.
Figure 3B:
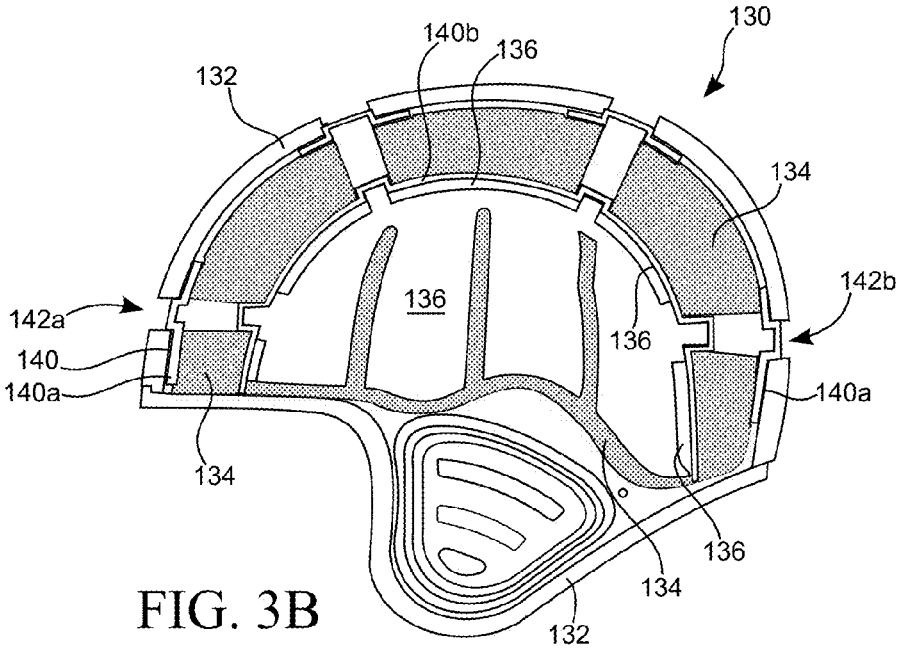

FIGS. 3A-3B show a non-limiting example of a hard shell helmet 130 comprising an outer shell 132 that is configured to receive an impact liner or other energy-absorbing layer 134, a comfort liner or fit liner 136, an attachment band or a hoop spring 140, and an attachment groove or opening 142. A hard shell helmet 130 can be a full face helmet, a skate bucket helmet, a motorcycle helmet, a snow sports helmet, a football helmet, a batting helmet, a catcher's helmet, a hockey helmet, or other similar helmet.

FIG. 3A shows a perspective view of an outside of a helmet 130 in which the outer shell 132 is depicted as being partially transparent so that a location of a band 140 on an inner surface of the outer shell 132 can be seen. The outer shell 132 can be formed of a plastic such as ABS or polycarbonate, resin, epoxy, fiberglass, carbon fiber, Kevlar or other fiber, and other suitable synthetic or natural materials. The outer shell 132 can provide energy management, puncture and abrasion resistance, and smooth aerodynamic finish as well as a decorative finish for improved aesthetics. The outer shell 132 can also provide a surface or area to which the impact liner 134 can be coupled and into which the impact liner can be disposed.

FIG. 3A shows a position of an attachment band 140 disposed within an outer shell 132, which is shown as being partially transparent for ease of explanation. The attachment band 140 can replace conventionally used snaps, hook and loop fasteners, adhesives, or other materials as known in the prior art and discussed above with respect to FIGS. 1B and 2A. The band 140 can include one or more layers of plastic including pliable or flexible plastics such as PE, PET, VN, ABS, PVC, or other suitable plastics, as well as metal, fiberglass, carbon fiber, textiles, Kevlar or other springy semi-rigid and semi-flexible material, whether synthetic or natural. For example, the band 140 can comprise first and second layers, such as a plastic layer coupled to a layer of foam VN. The band 140 may have a thickness in a range of 0.01 mm-1.0 cm.

The band 140 can comprise an annular, ring, hoop, halo, circular, oval or other closed shape that extends around a perimeter, equator, or circumference of the helmet as shown in FIG. 3A. The band 140 may also be formed of a plurality of separate or disjointed pieces, such as two pieces that are strategically positioned to couple adjacent halves of the band to a helmet 130 in forming a complete band. Alternatively, as shown in FIG. 3B, the band 140 can be an open shape or strip such as an arch shaped strip that extends partially or entirely across the helmet 140, such as from a first side to a second side of the helmet. Regardless of the number, shape, or geometric configurations of the band or bands 140, the bands can be elastically deformable to tend to spring back to an original position. The band 140 can be coupled to one or more impact liners 134 or to a comfort liner 136, as discussed below with respect to FIG. 3B by friction, by the elastic or spring-like nature of the band, and by being coupled to grooves or openings 142. Various aspects of attachment bands 140 are discussed below, including aspects that refer to bands 140*a* and 140*b*, each of which can comprise any number of the features of a band 140 as described above.

FIG. 3A shows a helmet 130 can further comprise one or more attachment grooves or openings 142 formed in or through an inner surface 144 of the shell 132. More specifically, the grooves 142 can be openings or holes, such as ventilation openings, that already exist in the helmet 130. As shown in the embodiment of FIG. 3A, the band 140 can be coupled to shell 132 by having lips, tabs, flanges, or inserts 146 disposed at least partially within grooves 142 to interlock, hold or maintain the band 140 coupled to the groove 142 and the outer shell 132. Thus a size, shape, area, and overall geometry of detents 146 can be sized and configured to mateably correspond and be releasably or permanently coupled within the grooves 142. Alternatively, the groove 142 can be formed as a groove 112 described above with respect to FIGS. 2A-2C.

The band 140 in FIG. 3A can use uniformly circumferential forces, or substantially uniform forces, of the band to removably couple the hoop and a liner to a helmet 130. The forces generated and received by the band 140 can be applied along a portion or an entirety of a length or area of the band. In accordance with the description of the band 140 and groove 142, the forces produced by, and applied to, the band 140 can be along or around a perimeter, equator, or circumference of the helmet as well as being along or around one or more open shapes or strips such as an arch shaped strip that extends partially or entirely across the helmet 140, such as from a first side to a second side of the helmet.

For each or the various geometries used for the band 140, additional energy management can be provided to the hard shell helmet 130 to help the hard shell helmet 130 pass the impact certification tests. Because hard shell helmets using EPP liners can have difficulty passing impact certification tests, the properties of the band 140 including flexibility, rigidity, and energy stored or absorbed during deformation of the band 140, can assist with overall energy management of impacts for the hard shell helmet 130. By increasing an overall capacity of energy absorption of the hard shell helmet 130 by incorporating the band 140, the hard shell helmet 130 can pass the relevant impact tests without having to increase a thickness of an EPP impact liner 134.

FIG. 3B is a cross-sectional profile view of a helmet 130 shown above in perspective view in FIG. 3A. FIG. 3B further comprises the additional detail of liners 134 and 136 disposed within a shell 132 and coupled to a helmet 130 using bands 140*a* and 140*b*. An impact liner 134 can be disposed inside a helmet 130 adjacent and in contact with an outer shell 132. An energy-absorbing layer 134 can be made of plastic, polymer, foam, rubber, rubbery foam, or other suitable energy-absorbing materials to absorb energy and to contribute to energy management for protecting a wearer during impact. The energy-absorbing layer 134 can be a resilient layer of EPP that will absorb energy from an impact by flexing without being crushed or cracking. The impact liner 134 can be permanently or releasably coupled to the outer shell 132 with a band 140 such as band 140*a*.

Helmets with EPP energy-absorbing layers can have more difficulty passing impact certification tests than helmets with EPS energy-absorbing layers. Advantageously, properties of a band 140 can work with an EPP liner to provide a helmet that passes the impact tests without having to increase a thickness of EPP beyond a typical range, e.g., a range of 0-2.5 cm or 0.5-1.5 cm. Smaller helmets with thinner wall dimensions increase safety because smaller helmets are more likely to be worn by people worried about wearing large bulky helmets, and those who will not wear helmets that do not satisfy popular aesthetic appeal. Use of the band 140 with the hard shell helmet 130 for energy management can occur independent of whether band 140 is also being used for coupling a liner such as the impact liner 134 to the hard shell helmet 130.

FIG. 3B also shows a comfort liner 136 can be disposed inside a helmet 130 while being adjacent and coupled to an impact liner 134 with band 140*b*. The comfort liner 136 can be made of textiles, plastic, foam, or other suitable material, such as polyester. The comfort liner 136 can be formed of one or more pads of material that can be joined together, or formed as discrete components, that are coupled to an hard shell helmet 130. The comfort liner 136 can be releasably or permanently coupled or directly attached to an impact liner 134 with attachment band 140*b*. By so doing, the comfort liner 136 can provide a cushion and improved fit for the wearer of the helmet 130 without the need or use of glue, snaps, hook and loop fasteners, or other conventional forms of attachment. In some aspects, the band 140*b* can also provide energy management in addition to coupling the impact liner 134, the comfort liner 136, and the outer shell 132 as part of the hard shell helmet 130.

As shown in FIG. 3B, multiple bands 140 of the same, similar, or different geometries can be used in a single helmet, such as bands 140*a* and 140*b*. As shown in FIGS. 3A and 3B, a first band 140*a* can be formed as a hoop or halo disposed around an perimeter, circumference, or equator of a helmet while a second band 140*b* can be an open shape or strip. FIG. 3B shows a band 140*b* can be formed as an open shape or strip such as an arch shaped strip that extends partially or entirely across the helmet 130, such as from a first or front side to a second or rear side of the helmet. While a band 140*b* can be formed as a strip that extends along a portion of the sagittal plane to resemble a mohawk, one or more strips 140*b* can also extend along the coronal plane or along any other plane or line along the helmet 130. Regardless of the number, shape, or geometric configurations of the band or bands 140*b*, the bands can be elastically deformable to tend to spring back to an original position. The band 140*b* can be coupled to a comfort liner 136 by being sewn to, or through, the comfort liner. The band 140*b* can also be coupled to a comfort liner 136 by having loops or portions of the comfort liner formed, disposed, woven, sewn, or sealed around the band without glue, snaps, hook and loop fasteners, or other conventional forms of attachment that could be used for coupling a comfort liner to an impact liner. Similar to the band 110, bands 140 can be disposed within the helmet 130 all at once; or alternatively, the bands 140 can be inserted into the helmet 130 a piece or portion at a time. In some embodiments the band 140*b* can be sized to custom fit the head of a wearer.

Advantageously, using the bands 140 for coupling the liners 136 and 134 to the helmet 130 and shell 132 allows for easy installation of the liners by workers assembling a helmet at a factory or at a store, as well as for helmet users doing the installation at home or on the go. Use of the bands 140 can further provide for releasable coupling that can facilitate removal and installation of liners for cleaning, maintenance, and replacement. Pressure points that were created by conventional mechanical attachments devices such as snaps, buttons, clasps, and hook and loop fasteners are eliminated, as is the secondary operation of installing or fastening a plurality of conventional mechanical attachments, such as four or more attachments, which can be cumbersome and time consuming.

Moreover, the band 140 or 140*a* can be integrally formed on or coupled to an impact liner 134 such as being integrally molded with an EPP impact liner. A corresponding groove 142, such as ventilation openings, can be formed in an outer shell 132 such that the EPP liner can be popped into the shell as part of a quick and efficient assembly at the factory for initial helmet assembly. Because glues and adhesives are typically used to attach a shell 132 to an impact liner 134, and because glues and adhesives typically contain solvents, which can be harmful to those assembling the helmets as well as harmful to the environment, the pop-in liner using a band 140 can reduce harmful effects for workers and the environment.

Similarly, a band 140 can be used to couple a first impact liner 134*a* to a second impact liner 134*b*, in which an impact liner 134*a* is an outer impact liner coupled to a shell 132 and an impact liner 134*b* is a custom-fit impact liner comprising an outer surface that can be coupled to the first impact liner and further comprising an inner surface 144*b* and opposite outer surface 144*a* that matches a contour of the head of the wearer. The inner surface 144*b* of the second impact liner 134*b* can be formed from a scan or measurements of the head of a wearer after which the second impact liner 134*b* can then sent or mailed to the wearer for quick and efficient insertion of the second impact liner at home or any other location.

The band 140*a* can reinforce and provide energy management of the hard shell helmet 130 at a same time it couples impact liner 134 to outer shell 132. Alternatively, band 140*a* can be for reinforcement of hard shell helmet 130 without coupling impact liner 134 to outer shell 132. When a band 140 such as the band 140*a* is used just for energy management, various geometries of one or more bands 140*a* can be used as indicated above with respect to the bands 140. Band 140*a* can be formed as a hoop or halo disposed around a perimeter, circumference, or equator of a helmet, as well as being an open shape or strip. When the band 140*a* is formed as an open shape or strip, such as an arch shaped strip that extends partially or entirely across the helmet 130, the band 140*a* can extend from a first or front side to a second or rear side of the helmet. The band 140*a* can also be formed as a strip that extends along a portion of the sagittal plane to resemble a Mohawk. One or more strips 140*a* can also extend along the coronal plane or along any other plane or line along the helmet 130. Regardless of the number, shape, or geometric configurations of the band or bands 140*a*, the bands can be elastically deformable to tend to spring back to an original position.

As indicated above, the band 140*b* can be formed of multiple materials and of multiple layers, or portions. In an embodiment, the band 140 can comprise one or more stress-indicating components that can be included within band 140. Stress-indicating components can be formed of one or more materials that undergo a change at a predetermined force or magnitude of impact. A predetermined change can be a change of color, a structural failure, or some other type of change that can be readily discernible to a wearer. For example, a stress-indicating component can be a pane of semi-rigid plastic material, like polycarbonate, that will fracture or crack after an impact of a known magnitude. Upon visual inspection of the stress-indicating component, a cracked or changed stress-indicating component can indicate that an impact of predetermined magnitude has occurred. Depending on the predetermined magnitude, different predetermined actions may be recommended or required, for example, a wearer may need medical attention, or a portion of the helmet might need to be replaced.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

a shell;

an energy-absorbing layer comprising expanded polystyrene (EPS) and a curved groove formed around a periphery of the energy-absorbing layer;

a comfort liner coupled to the energy-absorbing layer without glue, hook and loop fasteners, clasps, buttons, fasteners, or snaps; and a flexible band releasably disposed between the energy-absorbing layer and the comfort liner, wherein the flexible band is coupled to the comfort liner, and the flexible band is releasably disposed in the curved groove to releasably couple the comfort liner to the energy-absorbing layer.

2. The helmet of claim 1, wherein the flexible band forms a closed plastic hoop.

3. The helmet of claim 1, wherein the shell comprises stamped polyethylene terephthalate (PET).

4. The helmet of claim 1, wherein the comfort liner is coupled to the flexible band without glue, hook and loop fasteners, clasps, buttons, fasteners, or snaps disposed within the shell.

5. A helmet, comprising:

a shell;

an energy-absorbing layer coupled to the shell and comprising a channel around a periphery of an inner surface of the energy-absorbing layer;

a comfort liner; and a flexible band disposed between the energy-absorbing layer and a portion of the comfort liner, and extending across or partially across the helmet, wherein a circumferential force exerted by the flexible band upon the energy-absorbing layer from deforming the flexible band to seat the flexible band in the channel removably couples the comfort liner to the energy-absorbing layer.

6. The helmet of claim 5, wherein the flexible band is releasably coupled to the shell without glue, hook and loop fasteners, clasps, buttons, fasteners, or snaps.

7. The helmet of claim 6, wherein the energy-absorbing layer further comprises:

an outer layer of expanded polystyrene (EPS) coupled to the shell; and an inner layer of EPS comprising a custom-fit surface that matches a contour of a user's head, wherein the flexible band releasably couples the inner layer of EPS to the comfort liner.

8. The helmet of claim 6, wherein:

the shell comprises stamped polyethylene terephthalate (PET);

the comfort liner is coupled to the flexible band without glue, hook and loop fasteners, clasps, buttons, fasteners, or snaps;

the energy-absorbing layer comprises expanded polystyrene (EPS) and the channel is configured to receive the flexible band; and the flexible band comprises a plastic headband coupled between the comfort liner and the energy-absorbing layer.

9. A helmet, comprising:

a shell;

a liner disposed within the shell; and a flexible band disposed between the shell and a portion of the liner, wherein the liner further comprises an outer layer of expanded polystyrene (EPS) coupled to the shell, and an inner layer of EPS, the outer layer of EPS comprises a curved channel formed around a periphery of the outer layer of EPS, and the flexible band is disposed in the curved channel between the outer layer of EPS and the inner layer of EPS to releasably couple the inner layer of EPS to the outer layer of EPS and the shell.

10. A helmet, comprising:

a shell;

an energy-absorbing layer comprising an energy-absorbing material and a groove formed around a periphery of an internal surface of the energy-absorbing layer;

a comfort liner coupled to the energy-absorbing layer; and a flexible band extending across or partially across the helmet and releasably disposed into the groove between the energy-absorbing layer and the comfort liner, wherein the comfort liner is releasably coupled to the energy-absorbing layer at the groove via the flexible band.

11. The helmet of claim 10, wherein the flexible band forms a closed loop.

12. The helmet of claim 11, wherein the flexible band extends around at least one of a perimeter, an equator, and a circumference of the helmet.

13. The helmet of claim 10, wherein the flexible band has a thickness in a range of 0.01 mm-1.0 cm.

14. The helmet of claim 10, wherein the flexible band comprises two or more separate pieces.

15. The helmet of claim 10, wherein a circumference of the flexible band is sized to fit a user's head.

16. The helmet of claim 15, wherein a depth of the groove is equal to a thickness of the flexible band.

17. The helmet of claim 16, wherein a depth of the groove is in a range of 60%-140% of a thickness of the flexible band.

18. The helmet of claim 10, wherein one or more of a shape, a size, an area, and a position of the groove corresponds to one or more of a shape, a size, an area, and a position of the flexible band.

* * * * *